US012498196B2

(12) United States Patent
She

(10) Patent No.: US 12,498,196 B2
(45) Date of Patent: Dec. 16, 2025

(54) WATER GUN

(71) Applicant: Jiansheng She, Shantou (CN)

(72) Inventor: Jiansheng She, Shantou (CN)

( * ) Notice: Subject to any disclaimer, the term of this patent is extended or adjusted under 35 U.S.C. 154(b) by 0 days.

(21) Appl. No.: 19/211,422

(22) Filed: May 19, 2025

(65) Prior Publication Data

US 2025/0283687 A1 Sep. 11, 2025

(30) Foreign Application Priority Data

May 7, 2025 (CN) ..... 202520889262.1

(51) Int. Cl.
*F41B 9/00* (2006.01)

(52) U.S. Cl.
CPC ..... *F41B 9/0031* (2013.01); *F41B 9/0075* (2013.01)

(58) Field of Classification Search
CPC ..... F41B 9/00; F41B 9/0031; F41B 9/0059; F41B 9/0068; F41B 9/0075
See application file for complete search history.

(56) References Cited

U.S. PATENT DOCUMENTS 4,239,129 A * 12/1980 Esposito ..... F41B 9/0018 362/112
6,540,108 B1 * 4/2003 Johnson ..... F41B 9/0012 222/401
7,798,364 B1 * 9/2010 Eddins ..... F41B 11/62 239/419
10,234,233 B1 * 3/2019 Spikes ..... F41B 9/0037
2008/0245815 A1 * 10/2008 Ma ..... F41B 9/0071 222/79
2009/0247043 A1 10/2009 Liao
2013/0192576 A1 * 8/2013 Ma ..... F41B 9/0071 124/73
2016/0341515 A1 11/2016 Liang
(Continued)

FOREIGN PATENT DOCUMENTS

CN 2775594 Y * 4/2006 ..... F41B 9/0018
CN 111561837 A * 8/2020 ..... B05B 7/0012
(Continued)

OTHER PUBLICATIONS

Translation CN218916086U (Year: 2023).*
(Continued)

*Primary Examiner* — Eugene L Kim
*Assistant Examiner* — Alyssa M Hylinski
(74) *Attorney, Agent, or Firm* — Zhigang Ma

(57) ABSTRACT

A water gun is provided. On the water gun, when a liquid pump is turned on, liquid in a liquid storage device is injected into a first water tank through a water inlet hole. The liquid pump is used as a unique power source to synchronously perform two functions: In a first function, the liquid in the first water tank is extracted through the water outlet hole for being pressurized, thus forming a high-pressure jet water flow. In a second function, a dynamic pressure field is built inside the first water tank to force a part of the liquid to flow towards a second water tank through a water replenishment hole. The single-pump double-output design directly replaces a shooting water pump and a mist spray water pump that work independently in a traditional double-pump system, and fundamentally reduces power consumption.

14 Claims, 8 Drawing Sheets

(56) References Cited

U.S. PATENT DOCUMENTS

| | | | | |
|---|---|---|---|---|
| 2018/0094898 | A1* | 4/2018 | Ma | F41B 9/0071 |
| 2019/0176048 | A1* | 6/2019 | Ma | A63H 29/14 |
| 2023/0175810 | A1 | 6/2023 | Lessmann et al. | |

FOREIGN PATENT DOCUMENTS

| | | | |
|---|---|---|---|
| CN | 218916086 | U * | 4/2023 |
| CN | 219869299 | U * | 10/2023 |

OTHER PUBLICATIONS

Translation CN219869299U (Year: 2023).*
Translation CN111561837A (Year: 2020).*
Translation CN2775594Y (Year: 2006).*

* cited by examiner

WATER GUN

TECHNICAL FIELD

The present disclosure relates to the field of toys, and in particular, to a water gun.

BACKGROUND

Water guns can pressurize and pump liquid during operation, so that a particular amount of liquid can obtain kinetic energy and be sprayed out at a speed. In order to improve the realism of the existing water gun, a sprayer mechanism is usually added on the water gun. The sprayer mechanism can spray water mist and illuminate the water mist, thus simulating a gun flame effect.

However, the sprayer mechanism on the water gun needs to be additionally provided with a mist spray water pump and an atomizing water tank. The mist spray water pump pumps liquid into the atomizing water tank, so that an atomizing member on the atomizing water tank can be in direct contact with the liquid, and then the atomizing member can atomize and spray the liquid. In this way, the water gun needs to be provided with two water pumps: a shooting water pump for shooting liquid, and a mist spray water pump, so that the power consumption increases significantly, causing a short battery life of the product.

SUMMARY

The present disclosure provides a water gun, which can ensure a battery life while maintaining a mist spray function.

The present disclosure provides a water gun, including:

a gun body;

a liquid storage device, arranged on the gun body; and a pumping and atomizing device, comprising a liquid pump, a first water tank, a second water tank, and an atomizing member, wherein the liquid pump is arranged on the gun body; a water inlet hole, a water outlet hole, a water replenishment hole, and a flow-back hole are provided in the first water tank; the water inlet hole is communicated to the liquid storage device; the water outlet hole is communicated to the liquid pump; the water replenishment hole is communicated to the second water tank; a through hole is provided in the second water tank; the through hole is communicated to the atomizing member; the second water tank is communicated to the flow-back hole;

when the liquid pump works, liquid inside the liquid storage device enters the first water tank through the water inlet hole; the liquid inside the first water tank is conveyed into the liquid pump through the water outlet hole to be pressurized and sprayed out, and is also conveyed into the second water tank through the water replenishment hole to be further transported to the atomizing member through the through hole; and excess liquid that has not been atomized inside the second water tank flows back to the first water tank through the flow-back hole.

Preferably, the pumping and atomizing device further includes a box body and an isolator; the isolator is arranged inside the box body; one side of the isolator is enclosed with an inner wall of the box body to form the first water tank; the other side of the isolator is enclosed with the inner wall of the box body to form the second water tank;

the water inlet hole, the water outlet hole, and the through hole are provided in the box body; and the water replenishment hole and the flow-back hole are provided in the isolator.

Preferably, the atomizing member includes a fixing plate and an atomizing sheet; the fixing plate is arranged on the box body; the atomizing sheet is arranged on the fixing plate; and the atomizing sheet covers the through hole.

Preferably, the isolator includes an isolation plate and a guide cylinder; both the isolation plate and the guide cylinder are located inside the box body; the guide cylinder is arranged on the isolation plate; the two sides of the isolation plate are respectively enclosed with the inner wall of the box body to form the first water tank and the second water tank; the water replenishment hole is provided in the isolation plate;

one end of the guide cylinder presses against the inner wall of the box body, so that the guide cylinder and the inner wall of the box body are jointly enclosed to form a guide channel; the water outlet hole is communicated to the guide channel; a flowing hole is provided in one end of the guide cylinder; the flowing hole is communicated to the first water tank and the guide channel; the flow-back hole is provided in the other end of the guide cylinder;

the guide channel receives, through the flow-back hole, excess liquid that has not been atomized inside the second water tank, and further receives, through the flowing hole, the liquid inside the first water tank.

Preferably, the water gun further includes a light-emitting device; the light-emitting device comprises a mounting cylinder, a bracket, an LED (Light Emitting Diode) board, and an LED (Light Emitting Diode);

the mounting cylinder is arranged on the gun body; the bracket is arranged inside the mounting cylinder; the LED board is arranged inside the bracket; the LED is arranged on the LED board;

a liquid spraying hole is provided in the bracket; the bracket and an inner wall of the mounting cylinder jointly define a plurality of mist spraying holes; the liquid spraying hole is communicated to the liquid pump; the liquid spraying hole is configured to: receive liquid pumped out by the liquid pump and guide the liquid to be sprayed out; and the mist spraying holes are communicated to the atomizing member.

Preferably, a position of the flow-back hole is higher than a position of the water replenishment hole.

Preferably, a hole diameter of the water inlet hole and a hole diameter of the water outlet hole are both greater than a water diameter of the water replenishment hole.

The hole diameter of the water inlet hole and the hole diameter of the water outlet hole are both greater than a hole diameter of the flow-back hole.

Preferably, the hole diameter of the water inlet hole is 1.5 mm to 4.5 mm;

the hole diameter of the water replenishment hole is 0.8 mm to 2.5 mm;

the hole diameter of the flow-back hole is 0.8 mm to 2.5 mm.

Preferably, the liquid pump includes a motor, a gear transmission group, a pump cylinder, a piston, an elastic reset member, and a nozzle;

the motor is arranged inside the gun body, and is in intermittent-driving connection to the piston through the gear transmission group; the pump cylinder is arranged on the gun body; the piston is slidably arranged inside the pump cylinder; the elastic reset member is in driving connection to the piston; a pump suction hole and a pump-out hole are provided in the pump cylinder; the pump suction hole is communicated to the water outlet hole; the nozzle is arranged on the pump-out hole;

when the motor drives the piston to move through the gear transmission group, the liquid is sucked in through the pump suction hole, and the piston presses against or drives the elastic reset member to deform, thereby increasing elastic potential energy of the elastic reset member; and the elastic reset member is configured to drive the piston to reset when released, so that the liquid in the pump cylinder flows through the pump out hole to the nozzle for spraying.

Preferably, the gear transmission group includes a driving gear, a plurality of transmission gears, an intermittent gear, and a rack;

the motor is in driving connection to the driving gear; the transmission gears are meshed in sequence; the driving gear is meshed with one of the transmission gears; the intermittent gear is coaxially connected to another transmission gear; the rack is connected to the piston, and the intermittent gear is intermittently meshed with the rack;

when the intermittent gear is meshed with the rack, the driving gear is driven by the motor to drive the transmission gears to rotate, thereby driving the intermittent gear to rotate and driving the piston to move through the rack; and when the intermittent gear is separated from the rack, the elastic reset member is released to drive the piston to be reset.

Preferably, a mounting slot is provided in the gun body; a liquid guide head is arranged in the mounting slot; the liquid guide head is communicated to the water inlet hole;

the liquid storage device includes a drum and a connector; a liquid chamber is provided inside the drum; the connector is arranged on the drum; the connector is communicated to the liquid chamber; and the drum is detachably inserted into the mounting slot, so that the connector is communicated to the liquid guide head.

The present disclosure has the following beneficial effects:

A water gun is provided. On the water gun, when a liquid pump is turned on, liquid in a liquid storage device is injected into a first water tank through a water inlet hole. The liquid pump is used as a unique power source to synchronously perform two functions: In a first function, the liquid in the first water tank is extracted through the water outlet hole for being pressurized, thus forming a high-pressure jet water flow. In a second function, a dynamic pressure field is built inside the first water tank to force a part of the liquid to flow towards a second water tank through a water replenishment hole. The single-pump double-output design directly replaces a shooting water pump and a mist spray water pump that work independently in a traditional double-pump system, and fundamentally reduces power consumption.

In addition, the liquid flowing into the second water tank continuously infiltrates the atomizing member through a through hole under the action of gravity, to implement liquid atomization and spraying. Therefore, when an atomizing demand is suspended, that is, when the atomizing member stops atomizing the liquid, the liquid can still be transported to the second water tank, but excess liquid inside the second water tank can still automatically return to the first water tank through a flow-back hole for spraying.

BRIEF DESCRIPTION OF THE DRAWINGS

The exemplary implementations of the present disclosure will be described in more details by combining the accompanying drawings. The above and other objectives, features, and advantages of the present disclosure will become more obvious. In the exemplary implementations of the present disclosure, the same reference numerals generally represent the same components.

DETAILED DESCRIPTION OF THE EMBODIMENTS

Figure 1:
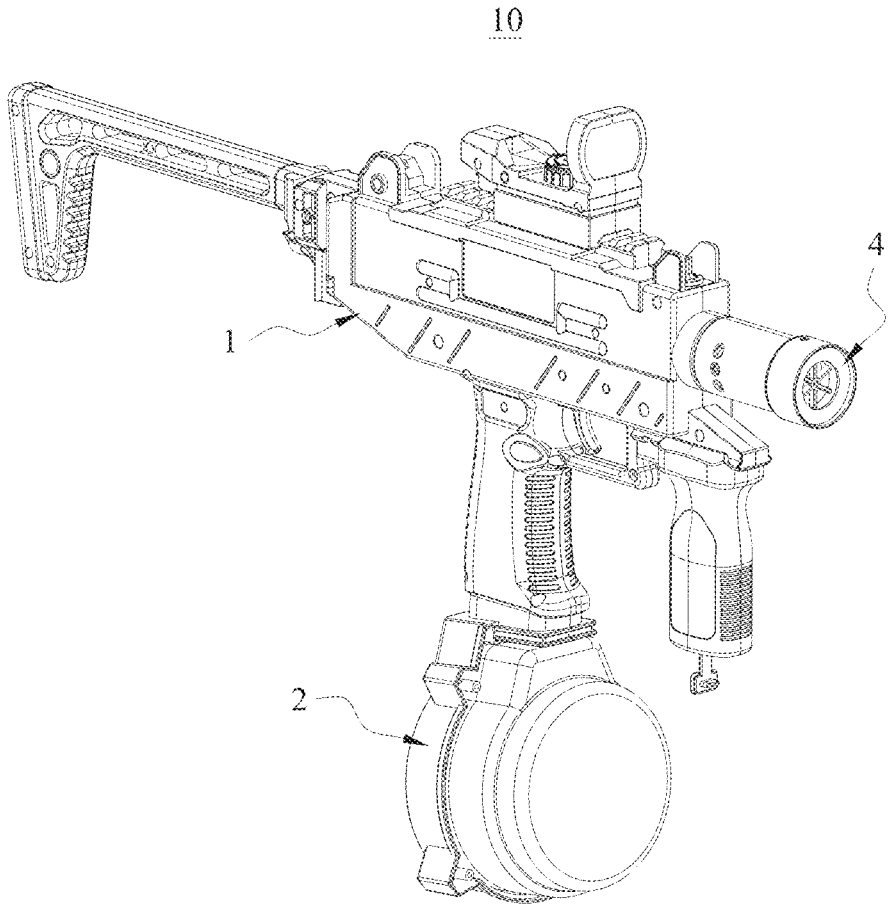
FIG. 1 is a schematic structural diagram of a water gun according to some embodiments of the present disclosure.

The implementations of the present disclosure will be described in more details below with reference to the accompanying drawings. Although the accompanying drawings show the exemplary implementations of the present disclosure, it should be understood that the present disclosure can be implemented in various forms, and should not be limited to the implementations stated herein. Rather, these implementations are provided for understanding the present disclosure more thoroughly and completely, and can completely transfer the scope of the present disclosure to those skilled in the art.

It should be understood that although various information may be described using terms such as "first", "second", and "third" in the present disclosure, such information should not be limited to these terms. These terms are only used to distinguish information of the same type from each other. For example, without departing from the scope of the present disclosure, the first information can also be referred to as the second information, and similarly, the second information can also be referred to as the first information. Thus, features defined as "first" and "second" explicitly or implicitly include one or more of the features. In the description of the present disclosure, "plurality" means two or more, unless otherwise expressly and specifically defined.

In the descriptions of the present disclosure, it should be understood that orientations or positional relationships indicated by the terms "length", "width', "upper", "lower", "front", "rear", "left", "right", "vertical", "horizontal", "top", "bottom", "inner", "outer", and the like are orientations or positional relationships as shown in the drawings, and are only for the purpose of facilitating and simplifying the descriptions of the present disclosure instead of indicating or implying that devices or elements indicated must have particular orientations, and be constructed and operated in the particular orientations, so that these terms are not construed as limiting the present disclosure.

Unless otherwise expressly specified and limited, the terms "mount", "connect", "connection", "fix" the like should be understood in a broad sense, such as, a fixed connection, a detachable connection, an integrated connection, a mechanical connection, an electrical connection, a direct connection, an indirect connection through an intermediate medium, an internal communication of two elements, or interaction between two elements. For those of ordinary skill in the art, the specific meanings of the aforementioned terms in the present disclosure can be understood based on specific conditions.

Figure 2:
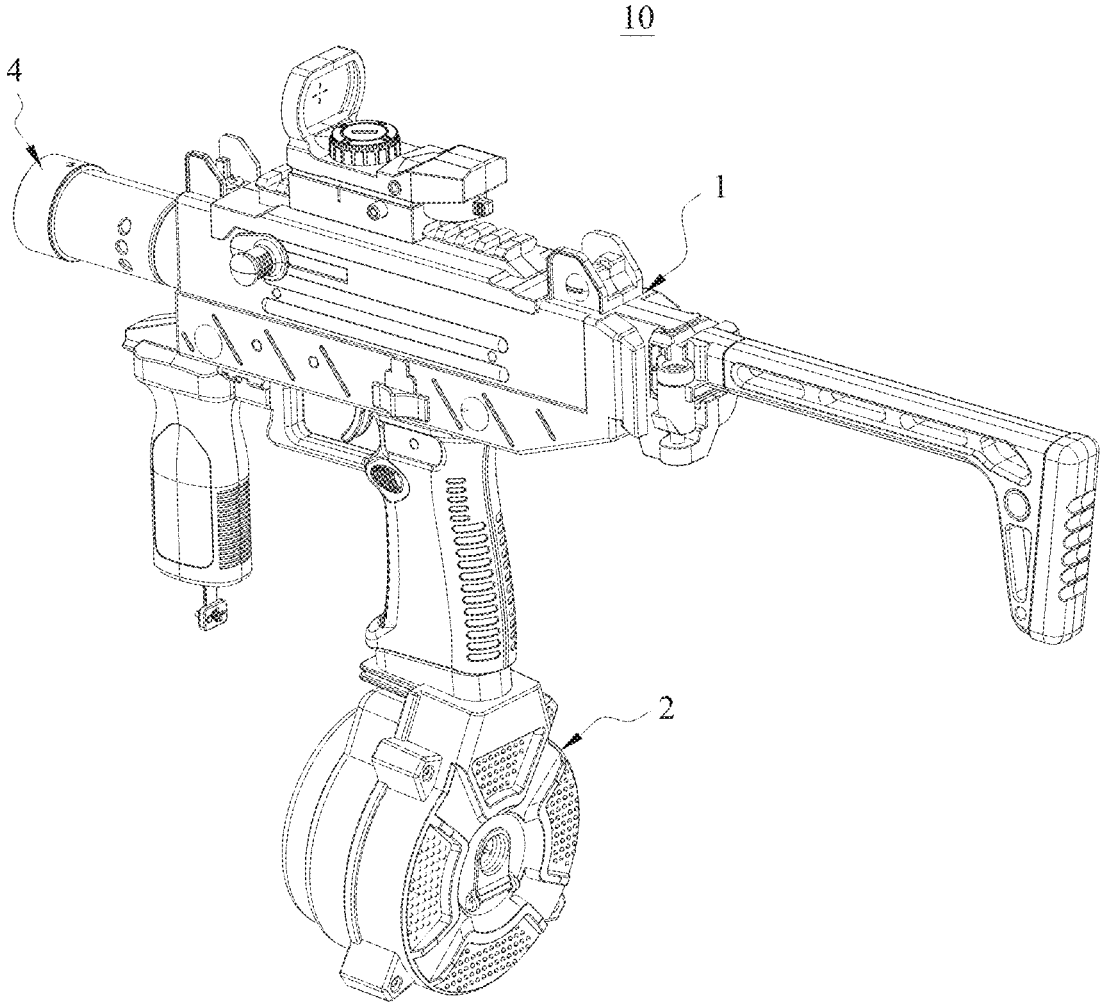
FIG. 2 is a schematic structural diagram of the water gun shown in FIG. 1, viewed in another angle.

FIG. 1 and FIG. 2 show a water gun 10 in some embodiments of the present disclosure. The water gun 10 includes a gun body 1, a liquid storage device 2, and a pumping and atomizing device 3.

It can be understood that an appearance structure of the gun body 1 can be flexibly set, and the gun body 1 plays a role of mounting and supporting other components. The liquid storage device 2 is arranged on the gun body 1 and is configured to store liquid. The pumping and atomizing device 3 is arranged on the gun body 1, and is communicated to the liquid storage device 2. The pumping and atomizing device 3 is configured to pressurize and spray liquid, and can also atomize and spray liquid.

As shown in FIG. 1 to FIG. 8, the pumping and atomizing device 3 includes a liquid pump 31, a first water tank 32, a second water tank 33, and an atomizing member 34. The liquid pump 31 is arranged on the gun body 1. A water inlet hole 321, a water outlet hole 322, a water replenishment hole 323, and a flow-back hole 324 are provided in the first water tank 32. The water inlet hole 321 is communicated to the liquid storage device 2. The water outlet hole 322 is communicated to the liquid pump 31. The water replenishment hole 323 is communicated to the second water tank 33. A through hole 331 is provided in the second water tank 33. The through hole 331 is communicated to the atomizing member 34. The second water tank 33 is communicated to the flow-back hole 324.

When the liquid pump 31 works, the liquid inside the liquid storage device 2 enters the first water tank 32 through the water inlet hole 321. The liquid inside the first water tank 32 is conveyed into the liquid pump 31 through the water outlet hole 322 to be pressurized and sprayed out, and is also conveyed into the second water tank 33 through the water replenishment hole 323 to be further transported to the atomizing member 34 through the through hole 331. Excess liquid that has not been atomized inside the second water tank 33 flows back to the first water tank 32 through the flow-back hole 324.

It can be understood that the liquid pump 31 is arranged on the gun body 1. The liquid pump 31 is configured to: apply a kinetic pressure to the liquid and output the liquid. The first water tank 32 is communicated to the liquid storage device 2 through the water inlet hole 321 to receive basic liquid flow. The water outlet hole 322 of the first water tank 32 guides the liquid to the liquid pump 31 for pressurized spraying. The water replenishment hole 323 is communicated to the second water tank 33 to transport liquid for atomization, and the flow-back hole 324 and the second water tank 33 form a closed loop to recycle excess liquid.

The second water tank 33 is communicated to the atomizing member 34 through the through hole 331. By the formation of the through hole 331, the liquid can flow to the atomizing member 34 for atomization. The communication between the through hole 331 and the water replenishment hole 323 achieves liquid diversion, and the communication between the through hole 331 and the flow-back hole 324 ensures the cyclic utilization rate of the liquid. The atomizing member 34 is configured to atomize and spray the liquid transported by the through hole 331.

It should be noted that when the liquid pump 31 is turned on, the liquid inside the liquid storage device 2 enters the first water tank 32 through the water inlet hole 321 and is divided into two paths: One path enters the liquid pump 31 through the water outlet hole 322 for pressurization and is then sprayed at a high speed. The other path is conveyed into the second water tank 33 via the water replenishment hole 323, and is then transported to the atomizing member 34 through the through hole 331 to complete atomization and spraying. Excess liquid that has not been atomized inside the second water tank 33 returns to the first water tank 32 through the flow-back hole 324, thus forming a dynamic balance.

It should also be noted that the atomizing member 34 can be configured as various components that can atomize liquid in the existing art.

As shown in FIG. 3 to FIG. 8, in some embodiments of the water gun, the pumping and atomizing device 3 further includes a box body 35 and an isolator 36. The isolator 36 is arranged inside the box body 35. One side of the isolator 36 is enclosed with an inner wall of the box body 35 to form the first water tank 32, and the other side of the isolator 36 is enclosed with the inner wall of the box body 35 to form the second water tank 33.

The water inlet hole 321, the water outlet hole 322, and the through hole 331 are provided in the box body 35; and the water replenishment hole 323 and the flow-back hole 324 are provided in the isolator 36.

It can be understood that the box body 35 is configured to store the liquid transported by the liquid storage device 2. The isolator 36 is configured to divide an internal space of the box body 35 into two chambers, one of which is the first water tank 32 and the other one of which is the second water tank 33. Through a nested structure of the isolator 36 and the box body 35, physical isolation and liquid interaction of the first water tank 32 and the second water tank 33, a compact structure, and high sealing performance are achieved.

It should be noted that in this embodiment, the desired connection between the first water tank 32 and the second water tank 33 can be completed by directly providing the water replenishment hole 323 and the flow-back hole 324 in the isolator 36, so that the water replenishment hole 323 and the flow-back hole 324 can be communicated to the second water tank 33 without pipelines, and liquid supplying to the second water tank and returning of the excess liquid can be completed. This greatly reduces the production costs of the product, reduces the complexity of assembling, and improves the production and assembling efficiency of the product. Meanwhile, it also improves the overall compactness of the product.

As shown in FIG. 4 to FIG. 8, in some embodiments of the water gun, the atomizing member 34 includes a fixing plate 341 and an atomizing sheet 342. The fixing plate is arranged on the box body 35. The atomizing sheet 342 is arranged on the fixing plate 341. The atomizing sheet 342 covers the through hole 331.

It can be understood that the rigid connection between the fixing plate 341 and the box body 35 ensures accuracy of alignment between the atomizing sheet 342 and the through hole 331, thus improving atomization stability. The atomizing sheet 342 directly covers the through hole 331, and the liquid is immediately treated by the atomizing sheet 342 after passing through the through hole 331, thus reducing an atomization delay. Meanwhile, the fixing plate 341 provides a mounting base for the atomizing sheet 342, making it easy to remove, maintain, or replace the atomizing sheet 342.

It should be noted that the atomizing sheet 342 can be configured as a commonly used microporous atomizing sheet in the existing art, or can be configured as another component in the existing art that can receive the liquid and generate and spray water mist.

As shown in FIG. 4 to FIG. 8, in some embodiments of the water gun, the isolator 36 includes an isolation plate 361 and a guide cylinder 362. The isolation plate 361 and the guide cylinder 362 are both located inside the box body 35, and the guide cylinder 362 is arranged on the isolation plate 361. The two sides of the isolation plate 361 are respectively enclosed with the inner wall of the box body 35 to form the first water tank 32 and the second water tank 33. The water replenishment hole 323 is provided in the isolation plate 361.

One end of the guide cylinder 362 presses against the inner wall of the box body 35, so that the guide cylinder 362 and the inner wall of the box body 35 are jointly enclosed to form a guide channel 363. The water outlet hole 322 is communicated to the guide channel 363. A flowing hole 3621 is provided in one end of the guide cylinder 362. The flowing hole 3621 is communicated to the first water tank 32 and the guide channel 363. The flow-back hole 324 is provided in the other end of the guide cylinder 362.

The guide channel 363 receives, through the flow-back hole 324, excess liquid that has not been atomized inside the second water tank 33, and further receives, through the flowing hole 3621, the liquid inside the first water tank 32.

It can be understood that the guide cylinder 362 is mounted on the isolation plate 361, and the guide cylinder 362 and the isolation plate 361 can be configured as being clamped, bonded, screwed, or the like. Certainly, the guide cylinder 362 and the isolation plate 361 can also be configured to be integrally formed and jointly manufactured. The isolation plate 361 divides the interior of the box body 35 into the first water tank 32 and the second water tank 33, thereby avoiding mixing of the liquid inside the two water tanks (the first water tank and the second water tank) through physical isolation, and achieving controllable liquid interaction through the water replenishment hole 323. Secondly, by providing the flowing hole 3621 and the flow-back hole 324 in the guide cylinder 362, flow-back path efficiency of the liquid from the first water tank 32 to the liquid pump 31 and the excess liquid inside the second water tank 33 is optimized.

It should be noted that in an actual operation process, the guide channel 363 can intensively guide two streams of liquid (pressurized liquid from the first water tank 32 and returned liquid from the second water tank 33) to the liquid pump 31. In this way, since the pressurized liquid and the returned liquid flow in through two ends of the guide channel 363 respectively, the interference of liquid turbulence is avoided, thus ensuring the stability of pressurized spraying and liquid circulation.

Figure 3:
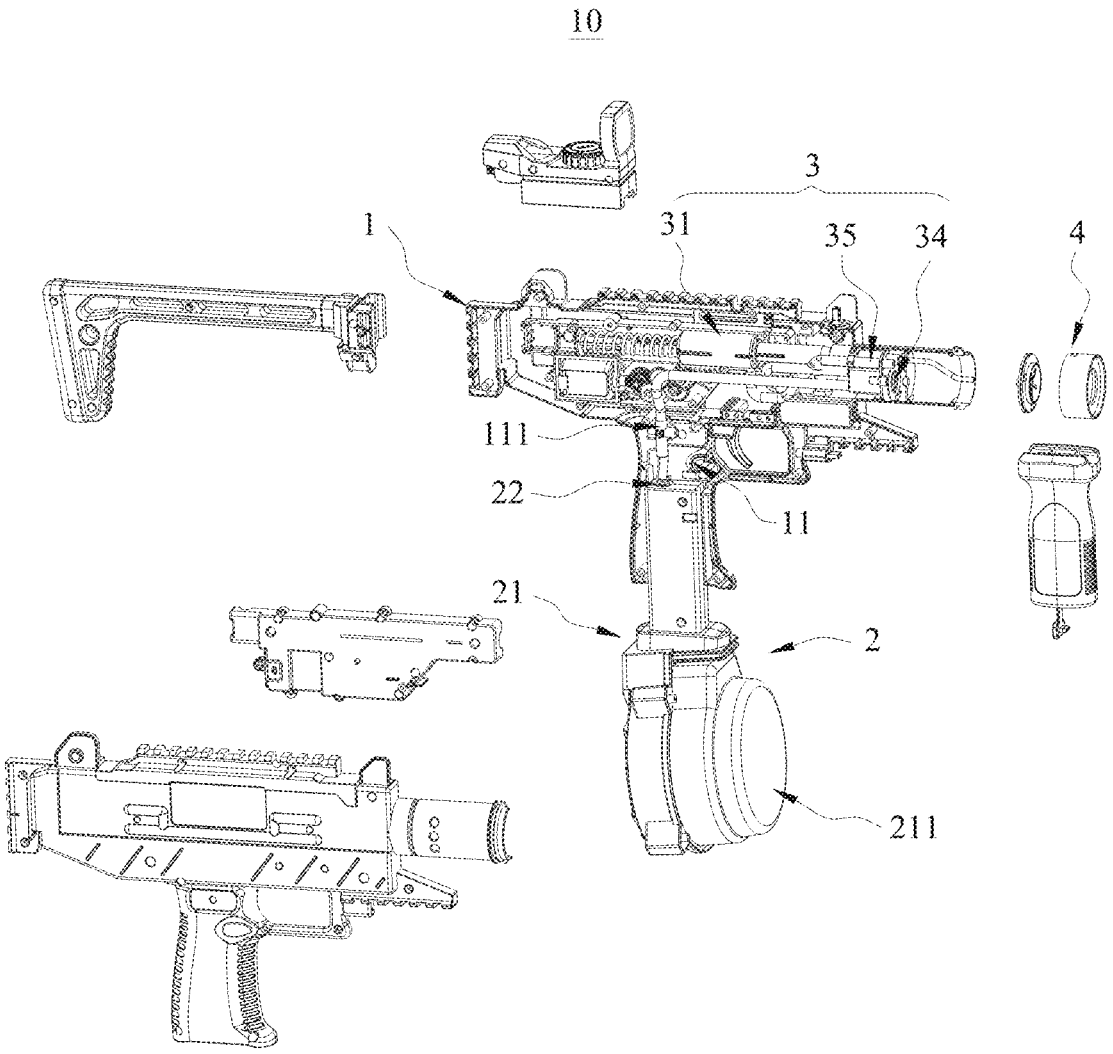
FIG. 3 is an exploded view of a water gun in some embodiments of the present disclosure.
Figure 4:
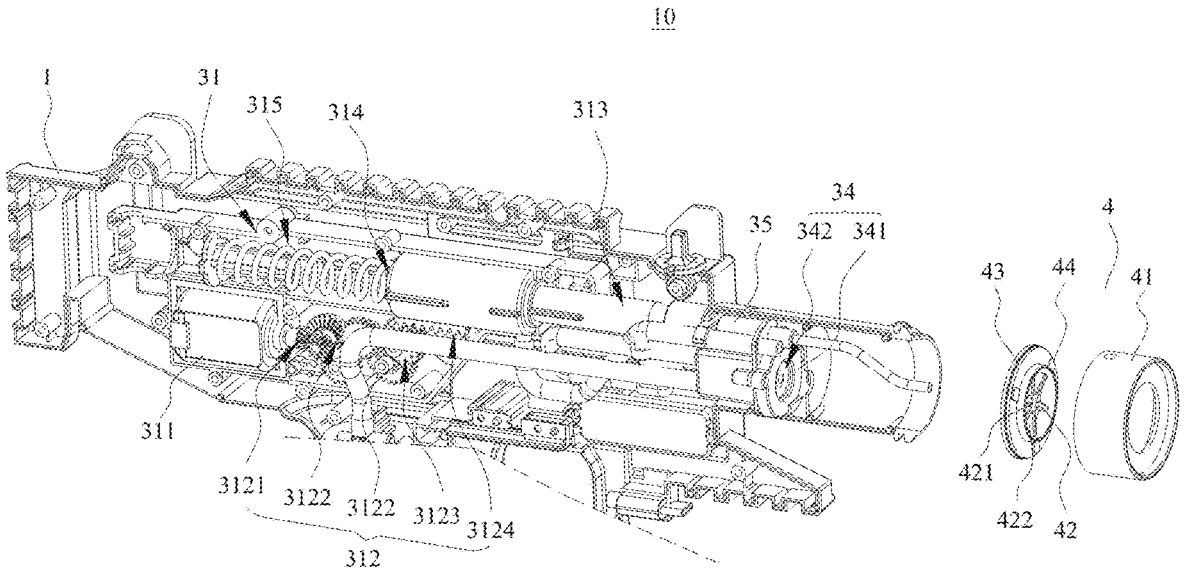
FIG. 4 is a partially schematic structural diagram of the water gun shown in FIG. 3.
Figure 5:
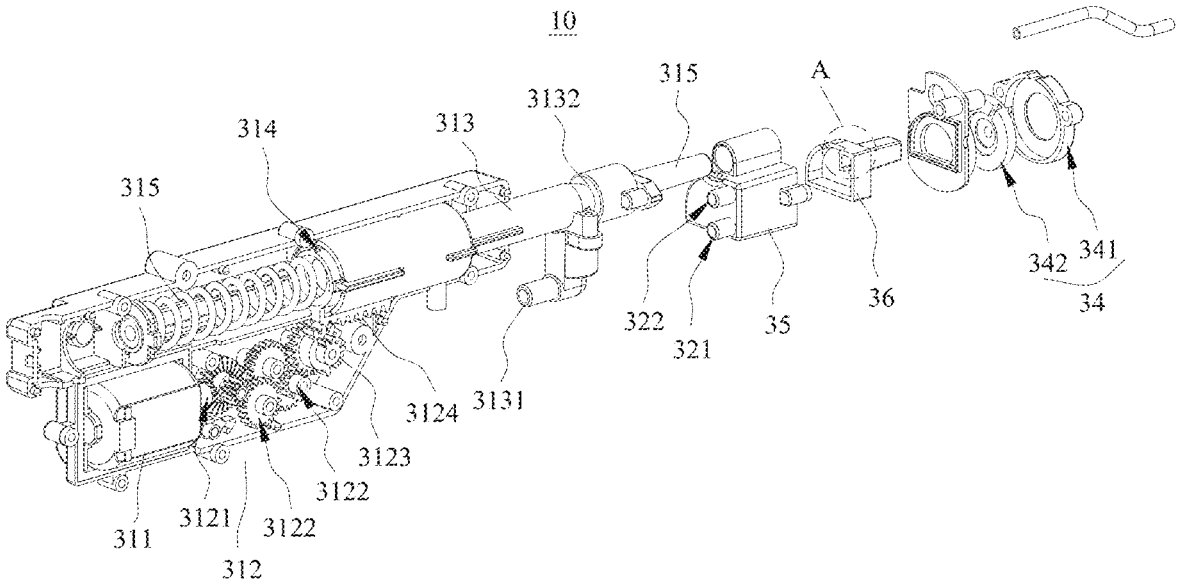
FIG. 5 is a partially schematic structural diagram of a water gun in some embodiments of the present disclosure.

As shown in FIG. 1 to FIG. 3, in some embodiments of the water gun, the water gun further includes a light-emitting device 4. As shown in FIG. 4 and FIG. 5, the light-emitting device 4 includes a mounting cylinder 41, a bracket 42, a LED board 43, and an LED 44.

The mounting cylinder 41 is arranged on the gun body 1. The bracket 42 is arranged inside the mounting cylinder 41. The LED board 43 is arranged inside the bracket 42. The LED 44 is arranged on the LED board 43.

A liquid spraying hole 421 is provided in the bracket 42. The bracket 42 and an inner wall of the mounting cylinder 41 jointly define a plurality of mist spraying holes 422. The liquid spraying hole 421 is communicated to the liquid pump 31. The liquid spraying hole 421 is configured to: receive liquid pumped out by the liquid pump 31 and guide the liquid to be sprayed out. The mist spraying holes 422 are communicated to the atomizing member 34.

It can be understood that the mounting cylinder 41 can be configured to be arranged on the gun body 1 in a fastened, bolted, plugged, or integrally formed manner. The bracket 42 is configured to fix the LED board 43 and separate a flowing passage of the liquid spraying hole 421 from flowing passages of the mist spraying holes 422. The LED board 43 can be configured with a circuit board that can drive the LED 44 to work to emit light in the existing art. Light emitted by the LED 44 can be emitted into the sprayed water mist. The sprayed water mist refracts the light to enhance a visual effect and simulate a gun flame effect, thereby improving the realism of the product and enriching the function of the product. The liquid spraying hole 421 is configured to directionally guide a water column, which is pressurized by the liquid pump 31, to be sprayed. The mist spraying holes 422 are configured to allow the water mist to pass through.

Figure 6:
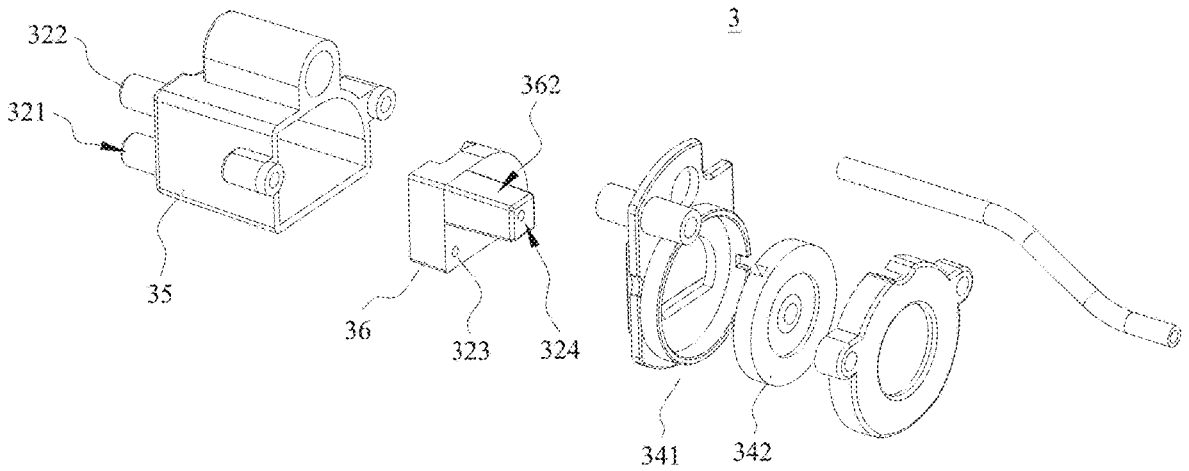
FIG. 6 is a schematic structural diagram of a pumping and atomizing device in some embodiments of the present disclosure.
Figure 7:
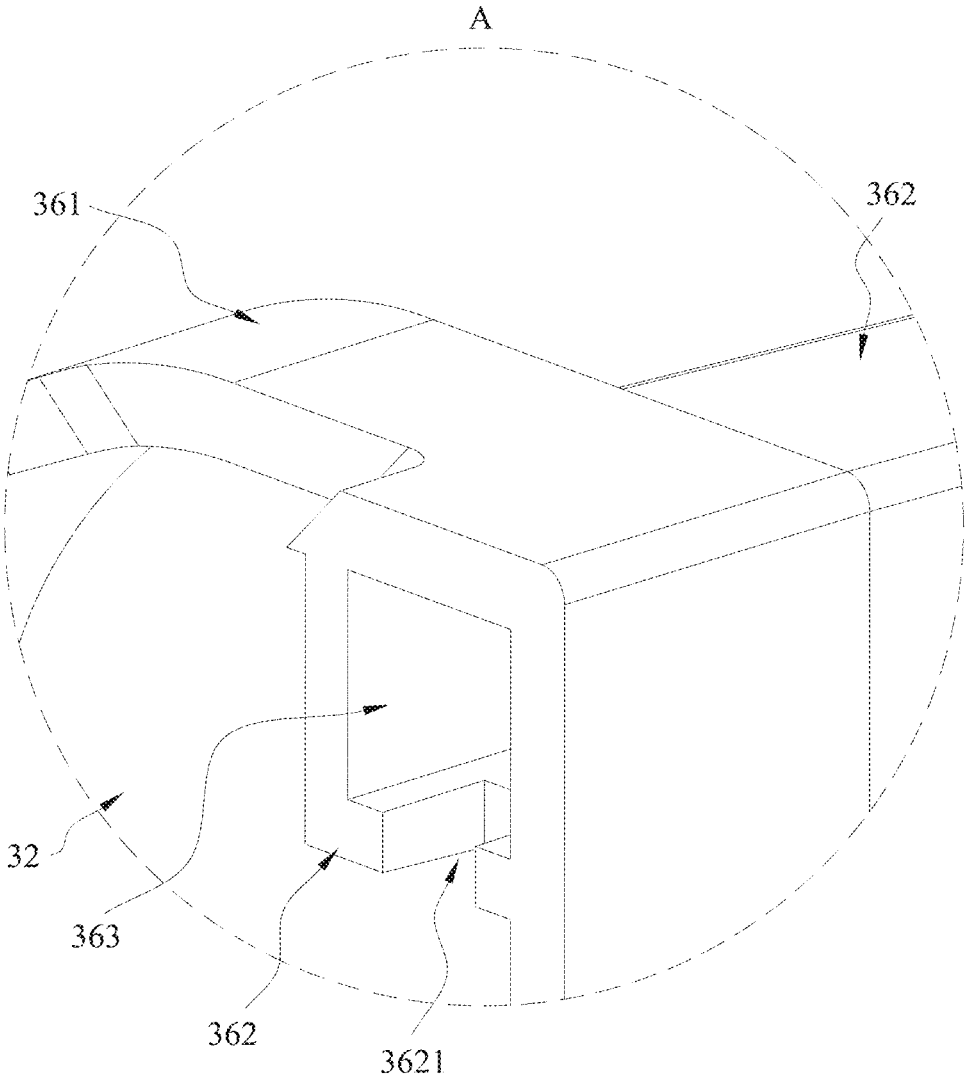
FIG. 7 is an enlarged view of part A in FIG. 5.
Figure 8:
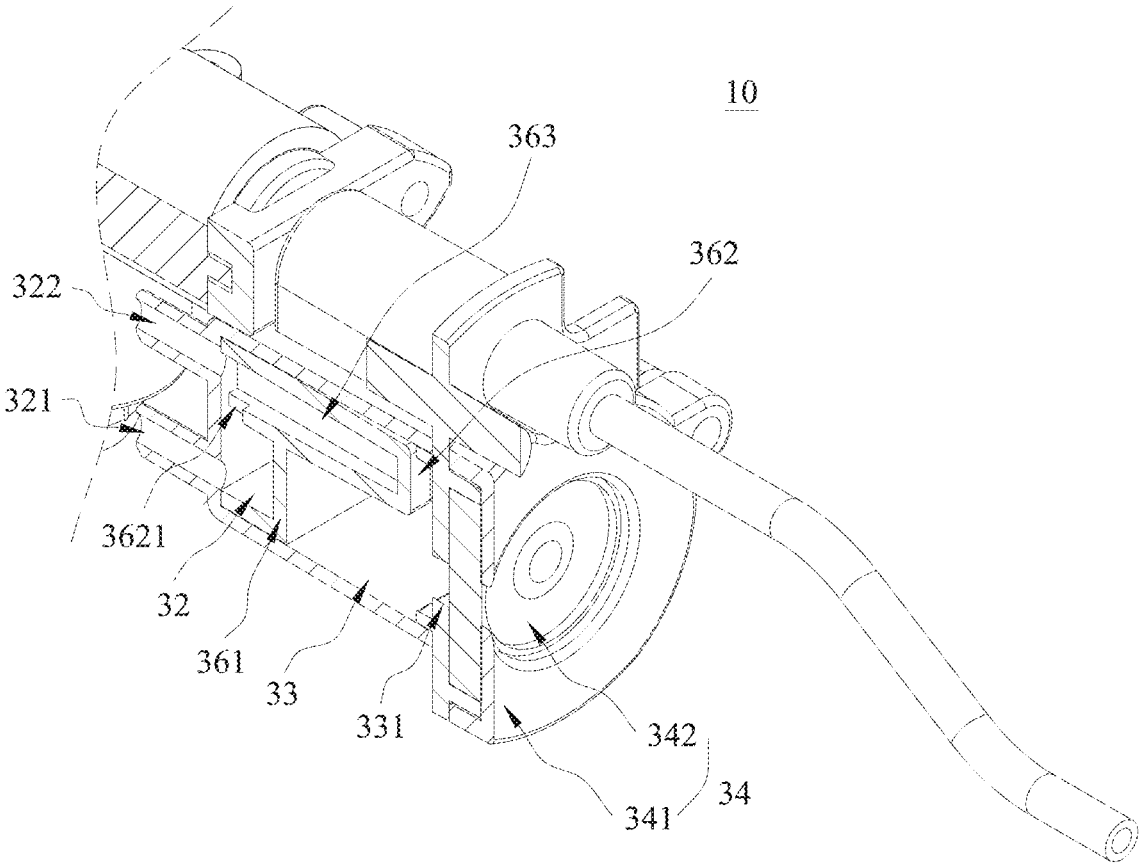
FIG. 8 is a schematic diagram of an internal structure of a water gun in some embodiments of the present disclosure.

As shown in FIG. 6 and FIG. 8, in some embodiments of the water gun, a position of the flow-back hole 324 is higher than a position of the water replenishment hole 323.

It can be understood that in this embodiment, priority control on liquid supplying is achieved through a spatial height difference, so that the excess liquid can be discharged through the flow-back hole 324 at the higher position only after it ensures that atomization liquid inside the second water tank 33 is sufficient.

It should be noted that when a liquid level inside the second water tank 33 is lower than the flow-back hole 324, the water replenishment hole 323 continues to replenish liquid, to preferentially meet a liquid demand of the atomizing member 34. After the liquid level rises to the height of the flow-back hole 324, the excess liquid automatically flows back to the first water tank 32 to prevent overflow of the second water tank 33.

As shown in FIG. 6 and FIG. 8, in some embodiments of the water gun, a hole diameter of the water inlet hole 321 and a hole diameter of the water outlet hole 322 are both greater than a water diameter of the water replenishment hole 323, and the hole diameter of the water inlet hole 321 and the hole diameter of the water outlet hole 322 are both greater than a hole diameter of the flow-back hole 324.

It can be understood that the water inlet hole 321 with the large hole diameter quickly replenishes the liquid from the water storage device 2 to the first water tank 32, thus avoiding idling of the liquid pump 31 due to insufficient liquid supplying. The water outlet hole 322 with the large hole diameter matches a high flow output demand of the liquid pump 31, to reduce flowing resistance and improving a water column spraying range. The water replenishment hole 323 with the small hole diameter limits a flow velocity of the liquid from the first water tank 32 to the second water tank 33, to prevent an overload on the atomizing sheet 342 caused by a sudden increase in the liquid level of the second water tank 33. The flow-back hole 324 with the small hole diameter reduces a flow-back velocity and avoids the interference of a sudden change in pressure on the first water tank 32 with stable operation of the liquid pump 31.

More specifically, the hole diameter of the water inlet hole 321 is 1.5 mm to 4.5 mm. The hole diameter of the water inlet hole 322 is 1.5 mm to 4.5 mm. The hole diameter of the water replenishment hole 323 is 0.8 mm to 2.5 mm. The hole diameter of the flow-back hole 324 is 0.8 mm to 2.5 mm.

As shown in FIG. 4 to FIG. 8, in some embodiments of the water gun, the liquid pump 31 includes a motor 311, a gear transmission group 312, a pump cylinder 313, a piston 314, an elastic reset member 315, and a nozzle 316.

The motor 311 is arranged inside the gun body 1, and is in intermittent-driving connection to the piston 314 through the gear transmission group 312. The pump cylinder 313 is arranged on the gun body 1. The piston 314 is slidably arranged inside the pump cylinder 313. The elastic reset member 315 is in driving connection to the piston 314. A pump suction hole 3131 and a pump-out hole 3132 are provided in the pump cylinder 313. The pump suction hole 3131 is communicated to the water outlet hole 322. The nozzle 316 is arranged on the pump-out hole 3132.

When the motor 311 drives the piston 314 to move through the gear transmission group 312, the liquid is sucked in through the pump suction hole 3131, and the piston 314 presses against or drives the elastic reset member 315 to deform, thereby increasing elastic potential energy of the elastic reset member 315. The elastic reset member 315 is configured to drive the piston 314 to do reset movement when released, so that the liquid in the pump cylinder 313 flows through the pump out hole 3132 to the nozzle 316 for spraying.

It can be understood that the motor 311 indirectly drives piston 314 to do reciprocating motion through the gear transmission group 312. The gear transmission group 312 is configured to transmit and convert rotation motion of the motor 311 into linear motion of the piston 314. The pump cylinder 313 is configured to: accommodate the piston 314 and form a closed chamber. The pump suction hole 3131 and the pump out hole 3132 are respectively configured for liquid suction and discharging. The piston 314 is configured to slide inside the pump cylinder 313. The piston 314 can transmit the elastic potential energy of the elastic reset member 315 to compress the liquid, and can also generate a negative pressure inside the pump cylinder 313 to pump the liquid. The elastic reset member 315 can deform and store energy when the piston 314 moves, and drive the piston 314 to be reset when released. The nozzle 316 is configured to constrain a liquid spraying direction. Further, the nozzle 316 can be configured in a tapered shape to improve a liquid spraying speed and range.

As shown in FIG. 3 to FIG. 5, in some embodiments of the water gun, the gear transmission group 312 includes a driving gear 3121, a plurality of transmission gears 3122, an intermittent gear 3123, and a rack 3124.

The motor 311 is in driving connection to the driving gear 3121. The transmission gears 3122 are meshed in sequence. The driving gear 3121 is meshed with one of the transmission gears 3122. The intermittent gear 3123 is coaxially connected to another transmission gear 3122. The rack 3124 is connected to the piston 314, and the intermittent gear 3123 is intermittently meshed with the rack 3124.

When the intermittent gear 3123 is meshed with the rack 3124, the driving gear 3121 is driven by the motor 311 to drive the transmission gears 3122 to rotate, thereby driving the intermittent gear 3123 to rotate and driving the piston 314 to move through the rack 3124. When the intermittent gear 3123 is separated from the rack 3124, the elastic reset member is released to drive the piston 314 to be reset and move.

It can be understood that the driving gear 3121 is connected to an output shaft of the motor 311 to transmit initial rotation power. The plurality of transmission gears 3122 are meshed in sequence to transmit a torque along a predetermined path. The intermittent gear 3123 is periodically meshed with/demeshed from the rack 3124 to control intermittent motion of the piston 314. The rack 3124 is configured to convert rotation motion of the intermittent gear 3123 into linear displacement of the piston 314.

It should be noted that the series arrangement of the plurality of stages of transmission gears 3122 reduces a volume of a transmission system and is suitable for the miniaturization design of the water gun.

As shown in FIG. 3, in some embodiments of water guns, a mounting slot 11 is provided in the gun body 1. A liquid guide head 111 is arranged in the mounting slot 11. The liquid guide head 111 is communicated to the water inlet hole 321.

The liquid storage device 2 includes a drum 21 and a connector 22. A liquid chamber 211 is provided inside the drum 21. The connector 22 is arranged on the drum 21. The connector 22 is communicated to the liquid chamber 211. The drum 21 is detachably inserted into the mounting slot 11, so that the connector 22 is communicated to the liquid guide head 111.

It can be understood that a contour of a slot wall of the mounting slot 11 is adapted to an outer box structure of the drum 21, so that the drum 21 can be stably assembled inside the mounting slot 11. After the drum 21 is aligned and assembled into the mounting slot 11, the connector 22 will be in plugging fit with the liquid guide head 111, so that the liquid chamber 211 is communicated to the first water tank 32 through the connector 22, the liquid guide head 111, and the water inlet hole 321.

The present disclosure has the following beneficial effects:

A water gun is provided. On the water gun, when a liquid pump is turned on, liquid in a liquid storage device is injected into a first water tank through a water inlet hole. The liquid pump is used as a unique power source to synchronously perform two functions: In a first function, the liquid in the first water tank is extracted through the water outlet hole for being pressurized, thus forming a high-pressure jet water flow. In a second function, a dynamic pressure field is built inside the first water tank to force a part of the liquid to flow towards a second water tank through a water replenishment hole. The single-pump double-output design directly replaces a shooting water pump and a mist spray water pump that work independently in a traditional double-pump system, and fundamentally reduces power consumption.

In addition, the liquid flowing into the second water tank continuously infiltrates the atomizing member through a through hole under the action of gravity, to implement liquid atomization and spraying. Therefore, when an atomizing demand is suspended, that is, when the atomizing member stops atomizing the liquid, the liquid can still be transported to the second water tank, but excess liquid inside the second water tank can still automatically return to the first water tank through a flow-back hole for spraying.

The schemes of the present disclosure have been described in more details above with reference to the accompanying drawings. In the foregoing embodiments, the description of each embodiment has respective focuses. For a part that is not described in detail in an embodiment, reference may be made to related descriptions in other embodiments. Those skilled in the art should also be aware that the actions and modules involved in this specification may not be necessary for the present disclosure. Furthermore, it can be understood that the steps in the method of the embodiments of the present disclosure can be sequentially adjusted, merged, and deleted according to actual needs. The modules in the device of the embodiments of the present disclosure can be merged, partitioned, and deleted according to actual needs.

The above has described the various embodiments of the present disclosure. The above explanation is exemplary, not exhaustive, and is not limited to the various embodiments disclosed herein. Many modifications and changes are obvious to those of ordinary skill in the art without deviating from the scope and spirit of the various embodiments described herein. The selection of the terms used herein aims to best explain the principles and practical applications of the various embodiments or improvements to technologies in the market, or to enable other persons of ordinary skill in the art to understand the various embodiments disclosed herein.

What is claimed is:

1. A water gun, comprising:

a gun body;

a liquid storage device, arranged on the gun body; and a pumping and atomizing device, comprising a liquid pump, a first water tank, a second water tank, and an atomizing member, wherein the liquid pump is arranged on the gun body; a water inlet hole, a water outlet hole, a water replenishment hole, and a flow-back hole are provided in the first water tank; the water inlet hole is communicated to the liquid storage device; the water outlet hole is communicated to the liquid pump; the water replenishment hole is communicated to the second water tank; a through hole is provided in the second water tank; the through hole is communicated to the atomizing member; the second water tank is communicated to the flow-back hole;

when the liquid pump works, liquid inside the liquid storage device enters the first water tank through the water inlet hole; a portion of the liquid inside the first water tank is conveyed into the liquid pump through the water outlet hole to be pressurized and sprayed out of the gun body and another portion of the liquid in the first water tank is conveyed into the second water tank through the water replenishment hole to be further transported to the atomizing member through the through hole; and excess liquid that has not been atomized inside the second water tank flows back to the first water tank through the flow-back hole.

2. The water gun according to claim 1, wherein the pumping and atomizing device further comprises a box body and an isolator; the isolator is arranged inside the box body; one side of the isolator is enclosed with an inner wall of the box body to form the first water tank; the other side of the isolator is enclosed with the inner wall of the box body to form the second water tank;

the water inlet hole, the water outlet hole, and the through hole are provided in the box body; and the water replenishment hole and the flow-back hole are provided in the isolator.

3. The water gun according to claim 1, wherein the atomizing member comprises a fixing plate and an atomizing sheet; the fixing plate is arranged on a box body; the atomizing sheet is arranged on the fixing plate; and the atomizing sheet covers the through hole.

4. The water gun according to claim 2, wherein the atomizing member comprises a fixing plate and an atomizing sheet; the fixing plate is arranged on the box body; the atomizing sheet is arranged on the fixing plate; and the atomizing sheet covers the through hole.

5. The water gun according to claim 2, wherein the isolator comprises an isolation plate and a guide cylinder; both the isolation plate and the guide cylinder are located inside the box body; the guide cylinder is arranged on the isolation plate; opposing sides of the isolation plate form the one side and the other side of the isolator to define the first and second water tanks; the water replenishment hole is provided in the isolation plate;

one end of the guide cylinder presses against the inner wall of the box body, so that the guide cylinder and the inner wall of the box body are jointly enclosed to form a guide channel; the water outlet hole is communicated to the guide channel; a flowing hole is provided in one end of the guide cylinder; the flowing hole is communicated to the first water tank and the guide channel; the flow-back hole is provided in the other end of the guide cylinder;

the guide channel receives, through the flow-back hole, excess liquid that has not been atomized inside the second water tank, and further receives, through the flowing hole, the liquid inside the first water tank.

6. The water gun according to claim 1, wherein the water gun further comprises a light-emitting device; the light-emitting device comprises a mounting cylinder, a bracket, an LED (Light Emitting Diode) board, and an LED (Light Emitting Diode);

the mounting cylinder is arranged on the gun body; the bracket is arranged inside the mounting cylinder; the LED board is arranged inside the bracket; the LED is arranged on the LED board;

a liquid spraying hole is provided in the bracket; the bracket and an inner wall of the mounting cylinder jointly define a plurality of mist spraying holes; the liquid spraying hole is communicated to the liquid pump; the liquid spraying hole is configured to: receive liquid pumped out by the liquid pump and guide the liquid to be sprayed out; and the mist spraying holes are communicated to the atomizing member.

7. The water gun according to claim 4, wherein the water gun further comprises a light-emitting device; the light-emitting device comprises a mounting cylinder, a bracket, an LED (Light Emitting Diode) board, and an LED (Light Emitting Diode);

the mounting cylinder is arranged on the gun body; the bracket is arranged inside the mounting cylinder; the LED board is arranged inside the bracket; the LED is arranged on the LED board;

a liquid spraying hole is provided in the bracket; the bracket and an inner wall of the mounting cylinder jointly define a plurality of mist spraying holes; the liquid spraying hole is communicated to the liquid pump; the liquid spraying hole is configured to: receive liquid pumped out by the liquid pump and guide the liquid to be sprayed out; and the mist spraying holes are communicated to the atomizing member.

8. The water gun according to claim 1, wherein a hole diameter of the water inlet hole and a hole diameter of the water outlet hole are both greater than a diameter of the water replenishment hole, and the hole diameter of the water inlet hole and the hole diameter of the water outlet hole are both greater than a hole diameter of the flow-back hole.

9. The water gun according to claim 4, wherein a hole diameter of the water inlet hole and a hole diameter of the water outlet hole are both greater than a diameter of the water replenishment hole, and the hole diameter of the water inlet hole and the hole diameter of the water outlet hole are both greater than a hole diameter of the flow-back hole.

10. The water gun according to claim 8, wherein a position of the flow-back hole is higher than a position of the water replenishment hole;

the hole diameter of the water inlet hole is 1.5 mm to 4.5 mm;

the hole diameter of the water replenishment hole is 0.8 mm to 2.5 mm;

the hole diameter of the flow-back hole is 0.8 mm to 2.5 mm.

11. The water gun according to claim 9, wherein a position of the flow-back hole is higher than a position of the water replenishment hole;

the hole diameter of the water inlet hole is 1.5 mm to 4.5 mm;

the hole diameter of the water replenishment hole is 0.8 mm to 2.5 mm;

the hole diameter of the flow-back hole is 0.8 mm to 2.5 mm.

12. The water gun according to claim 1, wherein the liquid pump comprises a motor, a gear transmission group, a pump cylinder, a piston, an elastic reset member, and a nozzle;

the motor is arranged inside the gun body, and is in intermittent-driving connection to the piston through the gear transmission group; the pump cylinder is arranged on the gun body; the piston is slidably arranged inside the pump cylinder;

the elastic reset member is in driving connection to the piston; a pump suction hole and a pump-out hole are provided in the pump cylinder; the pump suction hole is communicated to the water outlet hole; the nozzle is arranged on the pump-out hole;

when the motor drives the piston to move through the gear transmission group, the liquid is sucked in through the pump suction hole, and the piston presses against or drives the elastic reset member to deform, thereby increasing elastic potential energy of the elastic reset member; and the elastic reset member is configured to drive the piston to reset when released, so that the liquid in the pump cylinder flows through the pump out hole to the nozzle for spraying.

13. The water gun according to claim 12, wherein the gear transmission group comprises a driving gear, a plurality of transmission gears, an intermittent gear, and a rack;

the motor is in driving connection to the driving gear; the transmission gears are meshed in sequence; the driving gear is meshed with one of the transmission gears; the intermittent gear is coaxially connected to another transmission gear; the rack is connected to the piston, and the intermittent gear is intermittently meshed with the rack;

when the intermittent gear is meshed with the rack, the driving gear is driven by the motor to drive the transmission gears to rotate, thereby driving the intermittent gear to rotate and driving the piston to move through the rack; and when the intermittent gear is separated from the rack, the elastic reset member is released to drive the piston to be reset.

14. The water gun according to claim 1, wherein a mounting slot is provided in the gun body; a liquid guide head is arranged in the mounting slot; the liquid guide head is communicated to the water inlet hole;

the liquid storage device comprises a drum and a connector; a liquid chamber is provided inside the drum; the connector is arranged on the drum; the connector is communicated to the liquid chamber; and the drum is detachably inserted into the mounting slot, so that the connector is communicated to the liquid guide head.

* * * * *